United States Patent [19]

Capasso

[11] Patent Number: 4,676,320

[45] Date of Patent: Jun. 30, 1987

[54] SHUT-OFF DEVICE FOR A SPRINKLER ASSEMBLY

[75] Inventor: Vincent Capasso, Lansdale, Pa.

[73] Assignee: Fire Sprinkler Specialties, Inc., Lansdale, Pa.

[21] Appl. No.: 834,594

[22] Filed: Feb. 28, 1986

[51] Int. Cl.[4] ..... A62C 37/10; B25B 13/40

[52] U.S. Cl. ..... 169/90; 81/176.2; 137/382.5; 251/291

[58] Field of Search ..... 169/90; 137/382.5; 251/291, 292; 81/176.1-176.3

[56] References Cited

U.S. PATENT DOCUMENTS 2,940,344 6/1960 Taylor, Sr. ..... 81/176.2

2,985,242 5/1961 Papa ..... 169/90

FOREIGN PATENT DOCUMENTS 726877 2/1966 Canada ..... 81/176.2

*Primary Examiner*—Andres Kashnikow

*Attorney, Agent, or Firm*—Joseph W. Molasky & Assocs.

[57] ABSTRACT

A device for terminating the flow of fluid from an overhead sprinkler equipped with a cut-off valve. A recess within said device accepts the sprinkler head and returns the cut-off valve to its original position. A biased locking means is also provided so that the device can be secured against any unintended resumption of fluid flow.

7 Claims, 7 Drawing Figures

FIG. 4
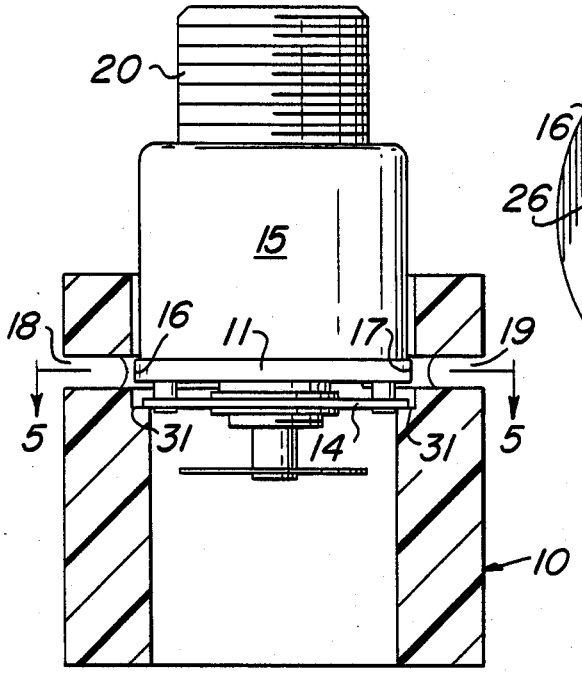
FIG. 5
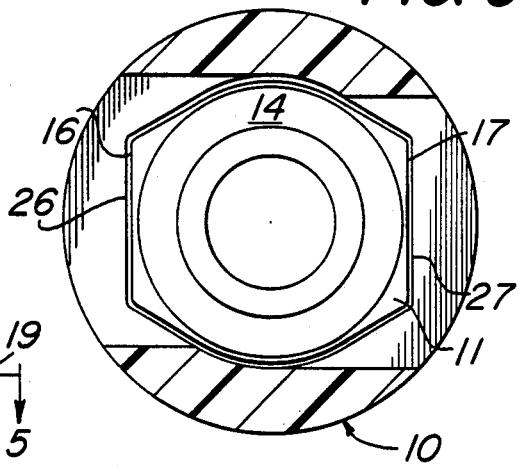
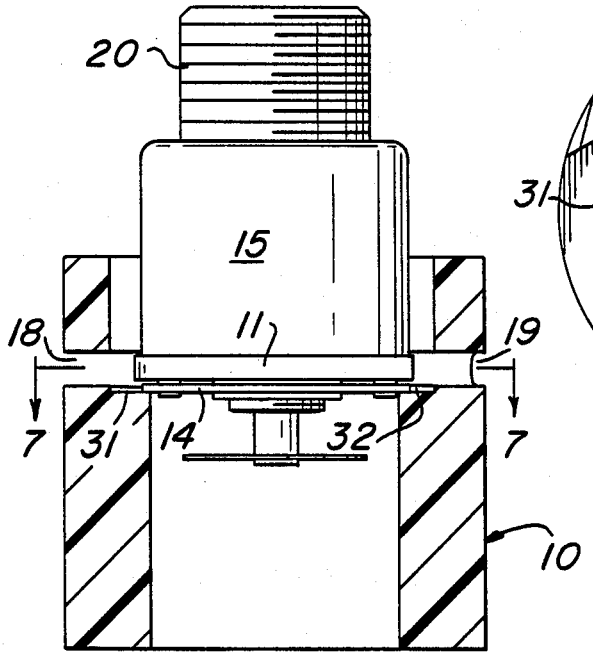
FIG. 6
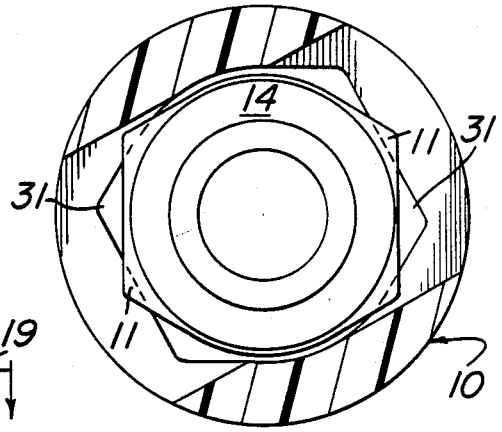
FIG. 7

SHUT-OFF DEVICE FOR A SPRINKLER ASSEMBLY

This invention relates to a closure device which may be installed on an activated sprinkler head to terminate the flow of fire-extinguishing fluid.

More specifically, this invention relates to a hollow cylindrical body which interrupts the flow of fluid from a sprinkler head by impressing into the fluid-conveying orifice a shut-off valve which obturates fluid flow. A rotatable locking means secures said device to the sprinkler head and ensures against inadvertent discharge.

Once the device has been installed and fluid flow has been terminated the device is allowed to remain on the sprinkler assembly in a locked mode and it may remain in this state without impairing the sprinkler's ability to perform in its intended manner. This latter feature is the result of a novel product structure which allows the device to become fluid within a precise temperature range so that under ordinary sprinkler-activating conditions the device loses its locking ability, separates, and allows the sprinkler head to resume its fire-quenching operation.

BACKGROUND

Most closure devices are awkward to install and they require the use of such force that damage to the sprinkler head often occurs.

When a fire has been brought under control the overhead sprinklers must be promptly inactivated to ensure that excess water will not inflict unnecessary damage. Many buildings are equipped with gravity-fed or pressure supplied water sources which discharge the fire-extinguishing fluid at rates which can flood a building within a relatively short period of time.

Accordingly, there is a need for a safe and effective device by which to ameliorate the damage which might result from a runaway sprinkler.

In U.S. Pat. No. 2,666,670, Vincent McGraw describes a closure device which installs easily and snaps away from the sprinkler head when the system is activated. However, this snap-away device has application only on dry sprinkler heads, that is, systems in which the heads do not contain a supply of fire-extinguishing fluid per se but which rely, instead, upon a water reservoir maintained at a remote source. The McGraw device has no application to wet sprinklers which contain within the head a supply of water for immediate discharge.

In U.S. Pat. No. 3,223,171, Walter DeGroot describes a closure plug comprised of telescoping members which are spring loaded. The spring has a compressive force which is at least equal to the force exerted by the water in the supply line to ensure that the plug will not be rejected. This plug is installed by the use of a mounting pole equipped with a triggering mechanism.

The DeGroot plug is neither inexpensive to manufacture or practical in its application because, in time, the spring assembly corrodes or loses its resiliency and becomes inoperable. Moreover, the inserted plug remains fixed and, as a consequence, the system cannot be reactivated until the plug is removed by hand.

From the foregoing it is obvious that a need remains for a closure device which can be used to terminate the flow of water from an activated sprinkler head in an effective, safe, convenient and inexpensive manner.

Moreover, there is a need for a closure device which can be allowed to remain on a sprinkler head in an inconspicuous manner and which does not require manual removal.

The present invention fills these needs by providing a closure device which can be manufactured inexpensively, installed easily and transported in volume without difficulty.

THE INVENTION

It is an object of this invention to provide a closure device for terminating water flow from an activated sprinkler head in an efficient manner with a modicum of effort.

More specifically, it is an object of this invention to provide a closure device which can be locked in place on an activated sprinkler head to obturate the flow of water and secure against inadvertent discharge.

Still another object is to provide a closure device which can be locked onto a sprinkler head without compromising its fire-extinguishing capabilities.

These and other objects are achieved by providing an integrally formed closure device which can be manufactured at low cost and installed rapidly in a safe and effective manner.

Structurally, the present device is a hollow cylindrical body contoured at one end to receive the flange and valve assembly of an activated sprinkler head. The contoured end includes a recess portion having sidewalls of generally oviform design for receiving the like-configured flange of a conventional sprinkler head.

The contoured recess portion extends downwardly within the hollow cylindrical body and terminates in an abutment which circumscribes the interior. This abutment serves as a seat for receiving the oviform-shaped flange and baffle plate of the sprinkler head assembly.

Immediately above said seat and directly opposite one another, within the recess portion, are channels which extend through the sidewalls so that they are visible from an outside view. Viewed from the inside the end segments of said channels tail off into depressions or grooves of gradually diminishing depth and they terminate in end segments of varying obliquity. At least one groove in each channel terminates in a biased end segment which is adapted to engage the flange of a sprinkler head valve assembly. This engagement results in a frictional locking means when the flange is turned in a clockwise direction and the cooperation is sufficient to retain the closure device on the sprinkler head until it is removed manually via a counterclockwise rotation or by a melt-down as hereinafter described.

In conventional sprinkler heads a fluid cut-off valve is retained within the fluid emitting orifice by a fusible composition and so long as sealing temperatures remain below a designated level the composition will retain said valve and the fluid flow will remain obturated.

When the designated temperature level is reached the fusible composiiton melts, the prevailing pressure forces said valve out of said orifice and the sprinkler is activated.

The present device does not interfere with this mode of operation because it is fabricated from materials which melt at sprinkler-activating temperatures. Accordingly, when the temperature within a given area reaches critical levels the closure device of this invention becomes pliable and then yielding as it converts from a solid to a melted mass. As the melt-down continues the device becomes fluid and ultimately it falls away from the sprinkler head so that the liquid stream can be evenly distributed without interference.

The materials from which the present device may be manufactured are, for example, thermoplastic resins having a melting point of from about 100°-250° C. and, preferably, 105°-120° C. Typical of these are, for example, cross-linked copolymeric resins derived from styrene and acrylonitrile which melt at temperatures of about 120° C. and, also; the copolymers of styrene, acrylonitrile and butadiene which exhibit a melting point range of from about 105°-115° C. Polysulfones, particularly the polyethersulfones, are also suitable as fabricating resins for the device of this invention, but the cross-linked reaction product of styrene and acrylonitrile is especially suitable and this resin constitutes a preferred fabricating material for this invention.

Other thermoplastic resins which may be employed are those derived from the copolymerization of trioxane with a minor amount of an acetyl comonomer. These resins possess carbon-to-carbon bonds in the polymer chain and they stabilize the polymer against various forms of degredative attack. Accordingly, when the copolymer is subjected to highly oxidative or acidic conditions the copolymer exhibits high stability and depolymerization generally stops short of the carbon-to-carbon link. Hydroxyethyl terminal units within the polymer chain also confer a high resistance to strongly alkaline environments. Copolymer resins which may be used to fabricate the device of this invention are those having a melting point range of from about 165°-250° C. as, for example, the resin known commercially as CELACON, a product of Celanese Engineering Resins of Chatham, N.J. which melts at about 165° C.

THE DRAWINGS

FIG. 4 is a side sectional view showing the combination of the closure device of this invention with a sprinkler head in its initial engagement stage.

FIG. 5 is a top sectional view of the closure device and sprinkler head shown in FIG. 4 along line 5—5.

FIG. 6 is a side sectional view showing the combination of the closure device of this invention with its sprinkler head assembly in the locking stage.

FIG. 7 is a top sectional view of the closure device and sprinkler head combination of FIG. 6 shown along line 7—7.

THE EMBODIMENTS

Figure 1:
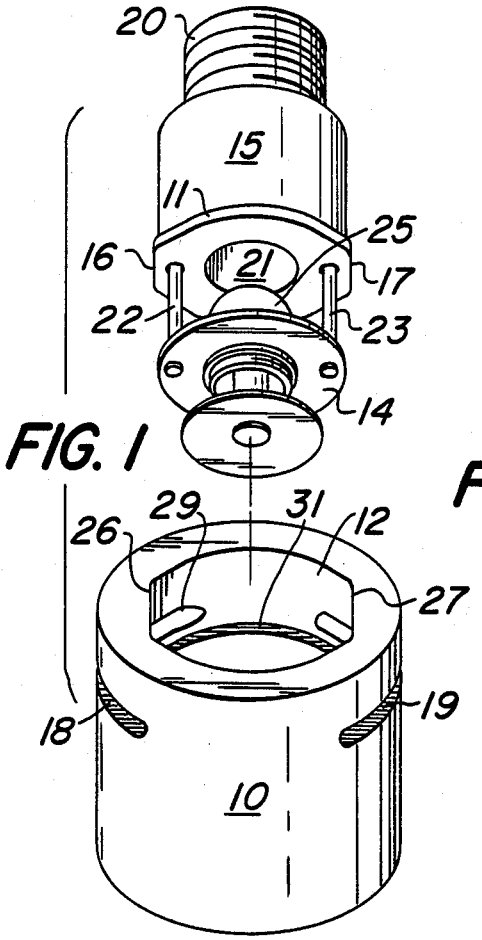
FIG. 1 is a perspective view of the closure device of this invention shown with a sprinkler head.

The device of this invention is the hollow cylindrical body shown as 10 in FIG. 1. This body is contoured to receive and lock an activated sprinkler 15 and secure same against fluid flow.

The sprinkler to which this invention applies is a commercial item for which no claim of novelty is asserted; however, its construction and mode of operation are relevant to the present invention and, therefore, its assembly is discussed in detail hereinbelow.

The sprinkler 15 includes a threaded conduit 20 for connecting to an overhead water supply (not shown), a fluid-emitting orifice 21 and a circumscribing flange 11 of generally oviform design.

Suspended beneath orifice 21 on guide rods 22 and 23 is a baffle plate 14 for receiving the liquid stream which is discharged from orifice 21 during a free-extinghishing operation. This baffle disperses the liquid in finely divided form and in a generally uniform pattern.

Figure 2:
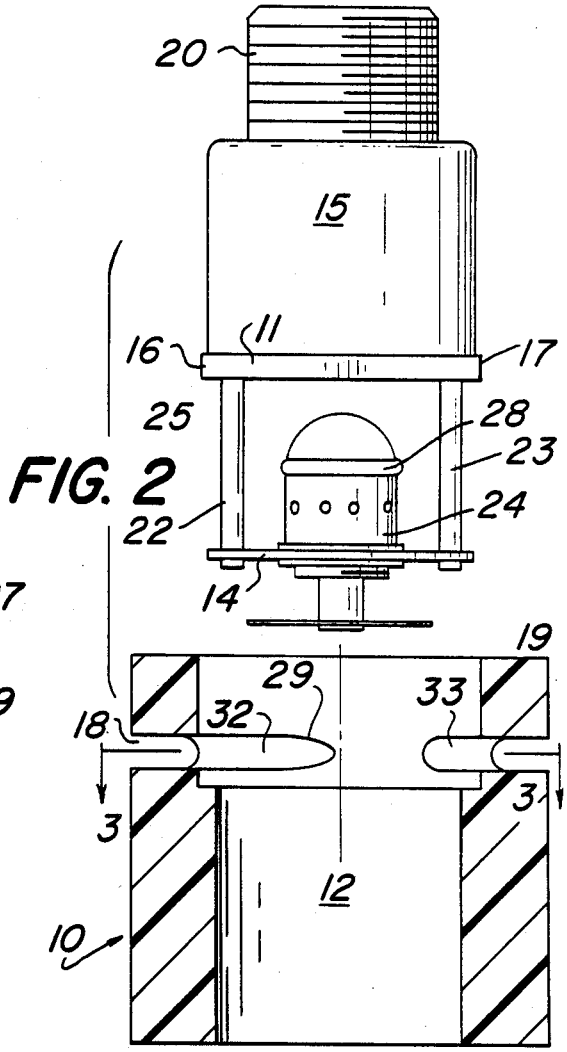
FIG. 2 is a side sectional view of the closure device of this invention shown in position for receiving the sprinkler head of FIG. 1.
Figure 3:
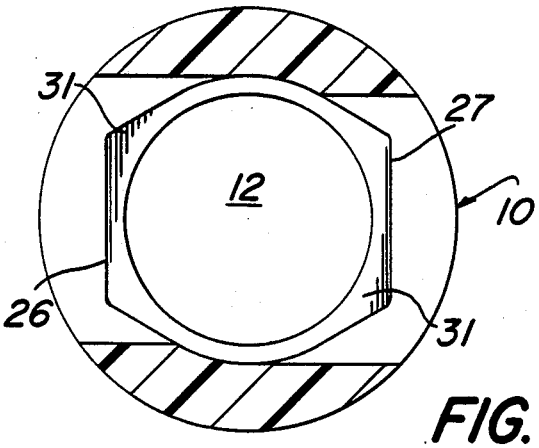
FIG. 3 is a top sectional view of the closure device of FIG. 2 along line 3—3.

The vertically disposed guide rods 22 and 23 cooperate with openings in flange 11 to provide means for raising and lowering said baffle plate and the attached valve 24 (FIG. 2). In FIGS. 1 and 2 the combination of baffle plate and valve are shown in an operational mode, that is, in position to receive the liquid stream which is to be discharged from orifice 21; whereas, FIGS. 4–7 show this assembly in a non-discharged mode.

The valve assembly includes a dome-shaped head 25 which guides valve 24 and the circumscribing rubber seal 28 into orifice 21 for engagement with conduit 20. When engagement occurs the seal 28 serves as a plug for terminating the liquid flow.

The interior of the present device includes a recess portion or cavity 12 which is contoured to receive the sprinkler head 11. This recess terminates in a seat 31 which extends laterally from the inner sidewalls of said recess to afford an abutment for engaging baffle plate 14.

Within said recess, immediately above seat 31, are opposing apertures which extend through the sidewall portion of said recess to form horizontal channels 18 and 19.

Externally, the device 10 is symmetrical and channel members 18 and 19 appear identical; however, an internal view shows that within recess 12 the channel members 18 and 19 extend laterally to form within the sidewall depressions of gradually diminishing depth. These depressions terminate in the oblique or biased segment shown as 29 in FIGS. 1 and 2. In these figures only the oblique segment for channel 18 is shown but both channels are identical and, therefore, it is to be understood that channel 19 terminates in an identical obliquity.

The device 10 will now be illustrated by describing its attachment to a sprinkler head assembly.

Operation:

The sprinkler shown as 15 in FIGS. 1 and 2 is a temperature-activated assembly 10 which employs a fusible composition to retain the cut-off valve 24 within the discharging orifice 21. So long as ambient temperatures remain below the melting point of this composition the valve 24 and its baffle plate attachment 14 will remain within conduit 20 and obturate the fluid flow.

The sprinkler is activated when an increase in temperature causes the fusible composition to melt and release its hold on sealing ring 28. When this occurs, the water pressure in conduit 20 expels the valve 24 and its baffle plate attachment from orifice 21 immediately ahead of the discharging stream. The stream thus emitted is converted into a uniform spray upon contact with dome 25, following which it is atomized to an even more finely divided dispersion by impringement on baffle plate 14.

The present device 10 terminates this fluid flow by returning valve 24 and sealing ring 28 into orifice 21. To achieve this result the device must first be aligned with the underside of said sprinkler so that its truncated segments 16 and 17 lie in registry with the identically configured end portions 26 and 27. When registry is assured the device 10 is impressed upwardly into sprinkler 15 so as to bring baffle plate 14 into engagement with seat 31 (FIG. 4). This engagement also brings the baffle plate 14 into juxtaposition with flange 11 while simultaneously returning valve 24 and sealing ring 28 into conduit 20 where they serve as a seal against further fluid discharge. In this engagement mode segments 16 and 17 of flange 11 are visible through channels 18 and 19 and thus provide the operator with a visual means for ensuring registry.

The foregoing illustrates the means by which the present device is used to terminate fluid flow in an activated sprinkler, but it does not ensure a permanent seal and, if left unattended, the pressure within conduit 20 will expel the valve assembly and reactivate the sprinkler assembly. To ensure against this occurrence the valve must be locked so that it can be left unattended and secured against inadvertent discharge.

The sprinkler is locked and secured by turning the closure device 10 in a clockwise direction so as to bring flange 11 into engagement with biased segment 29 of aperture 18 (FIG. 2). An identical and simultaneous engagement also occurs between flange 11 and the biased segment of aperture 19 so that in its locking mode flange 11 and closure device 10 cooperate as shown in FIGS. 6 and 7.

The device of this invention has a melting point comparable to that of the fusible composition. Accordingly, when ambient temperatures coincide with melt-down levels the composition loses its binding properties and it will no longer retain valve 24 within orifice 21. At essentially the same time but, more specifically, within the range of from about 100°–250° C., the closure device 10 also loses rigidity and its integrity is so diminished that it can no longer retain the valve assembly in its inoperable mode as a result of which the valve falls free and the sprinkler assembly is reactivated.

This invention has been described by reference to precise embodiments but it will be appreciated by those skilled in the art that this concept is subject to variation and modification and to the extent that these are within the skill of the artisan to effect, said variations and modifications are included within the scope of the appended claims.

What is claimed is:

1. A device for terminating fluid flow in a temperature-activated sprinkler comprised of a water conduit, flange, baffle plate and cut-off valve, which comprises:

(1) a cylindrical hollow body having at one end a recess portion contoured to receive a flange of truncated oviform design said body being comprised of a thermoplastic composition which melts at temperatures corresponding essentially to sprinkler-activating temperatures;

(2) a circular seat which circumscribes the interior of said body and abuts said recess portion, said seat being adapted to receive said baffle plate and simultaneously impress into said conduit a cut-off valve for terminating fluid flow; and (3) two apertures oppositely disposed within the sidewalls of said recess portion, both of which are adapted to engage said flange and provide a locking means.

2. The device of claim 1 wherein said apertures are horizontally disposed channels which are in juxtaposition with said seat.

3. The device of claim 2 wherein said apertures are in registry with the truncated portion of said flange.

4. The device of claim 1 wherein the flange-engaging apertures include a biased segment and engagement is achieved by frictional means.

5. The device according to claim 1 wherein said thermoplastic composition is a resin having a melting point of from about 100°–250° C.

6. The device according to claim 5 wherein said resin is a cross-linked copolymer having a melting point of from about 105°–120° C.

7. The device according to claim 6 wherein said resin is a copolymer derived from styrene and acrylonitrile.

* * * * *